US005855033A

United States Patent [19]

Frissen et al.

[11] Patent Number: 5,855,033

[45] Date of Patent: Jan. 5, 1999

[54] INFLATABLE BEACH BED

[75] Inventors: Leonardus Aleida Frissen; Simon Adriaan Troost, both of Breda, Netherlands

[73] Assignee: Marinus Anthonius Maria Van Tol, Rijen, Netherlands

[21] Appl. No.: 795,700

[22] Filed: Feb. 4, 1997

[51] Int. Cl.[6] ..... A47C 27/10

[52] U.S. Cl. ..... 5/706; 5/710; 5/711

[58] Field of Search ..... 5/706, 644, 654, 5/655.3, 932, 710, 731, 732, 739, 417, 419

[56] References Cited

U.S. PATENT DOCUMENTS

| | | | |
|---|---|---|---|
| D. 93,703 | 10/1934 | Coomber | 5/706 |
| D. 187,638 | 4/1960 | Kelly | 5/706 |
| 4,459,714 | 7/1984 | Lin | 5/455 |
| 4,723,329 | 2/1988 | Vaccaro | 5/455 |
| 4,766,629 | 8/1988 | Schueler | 5/451 |
| 4,876,756 | 10/1989 | Vaccaro | 5/455 |
| 4,964,183 | 10/1990 | LaForce, Jr. | 5/421 |
| 5,168,589 | 12/1992 | Stroh et al. | 5/455 |
| 5,604,945 | 2/1997 | Fisher et al. | 5/706 |
| 5,669,092 | 9/1997 | Lin | 5/706 |

FOREIGN PATENT DOCUMENTS

| | | |
|---|---|---|
| 29600087 U1 | 5/1996 | Germany . |
| 903557 | 8/1962 | United Kingdom . |

*Primary Examiner*—Kenneth J. Dorner
*Assistant Examiner*—Fredrick Conley
*Attorney, Agent, or Firm*—David P. Gordon; David S. Jacobson; Thomas A. Gallagher

[57] ABSTRACT

A beach bed includes a flexible, thin-walled plane made from synthetic material, e.g. PVC. It is made up of a central part and a peripheral inflatable part separated by means of one or more heat seals, whereby the inflatable part, when inflated, form a boxed-in area around the central part. The inflatable part, when inflated is provided with at least one part that is raised relative to the rest of the inflatable part. With an item of this design it is possible for the user to make himself comfortable on a sandy surface and at the same time prevent sand from blowing on himself and any items he has placed in the central part. Furthermore, a beach towel may be coupled to the beach bed. Moreover, advertising may be printed on the central part of the beach bed.

6 Claims, 1 Drawing Sheet

INFLATABLE BEACH BED

BACKGROUND OF THE INVENTION

1. Field of the Invention

This invention relates to inflatable items. More particularly, this invention relates to an inflatable beach bed for recreational use.

2. State of the Art

When lying on the beach a beachgoer usually uses a beach towel. The main disadvantage of a beach towel is that a person lying on top of the towel generally comes into contact with blowing sand in a very annoying way. In addition, a beach towel does not always stay in place and may partly become covered in sand.

One alternative is for a beachgoer to use an air mattress to raise himself off the sand and reduce the chance that sand will blow upon him. However, air mattress have several disadvantages for beach use. First, an air mattress usually requires a large amount of air for inflation. Time spent inflating an air mattress is time taken away from the beach experience. In addition, the relatively large inflatable volume of an mattress requires expending a large amount of effort to inflate the air mattress. Second, the air mattress raises the beachgoer off the sand, such that the beachgoer no longer has the desired experience of the feel of the sand beneath him.

SUMMARY OF THE INVENTION

It is therefore an object of the invention to provide an inflatable beach item with which the beachgoer can protect himself and his belongings from blowing sand.

It is also an object of the invention to provide an inflatable beach item which allows the beachgoer to feel the sand beneath him.

It is another object of the invention to provide an inflatable beach item which requires little effort to inflate.

In accord with these objects which will be discussed in detail below, an inflatable beach bed is provided having a thin-walled flexible plane made up of a central part and a peripheral contour part. The peripheral contour part includes at least one inflatable part which is separated from the central part by means of one or more heat seals. Preferably, the peripheral part includes a raised contour part which is inflatable to a larger height relative to the other portions of the inflatable part. As a result, the central part and the inflatable part together form a boxed-in area in which the inflatable part boxes in the central part. In addition, when inflated, the inflatable part is raised in relation to the rest of the boxed-in area along at least one of the sides. A beach bed of this design, when inflated, allows a beach goer lying on the central part to experience the desired contact with the contours of the sandy surface. In addition, the inflated parts form an edge which protects the beach goer and the items he places therebetween, from blowing sand.

Preferably a construction is used which allows the raised contour part of the boxed-in area to be inflated separately. The added advantage of this is that it then becomes possible to use such a raised contour part as a pillow, which the user can adjust to his own comfort. It is also preferable that the central part be held in taut condition by the inflated peripheral contour part, as a result of which the desired shape of the boxed-in area obtained is fully maintained.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
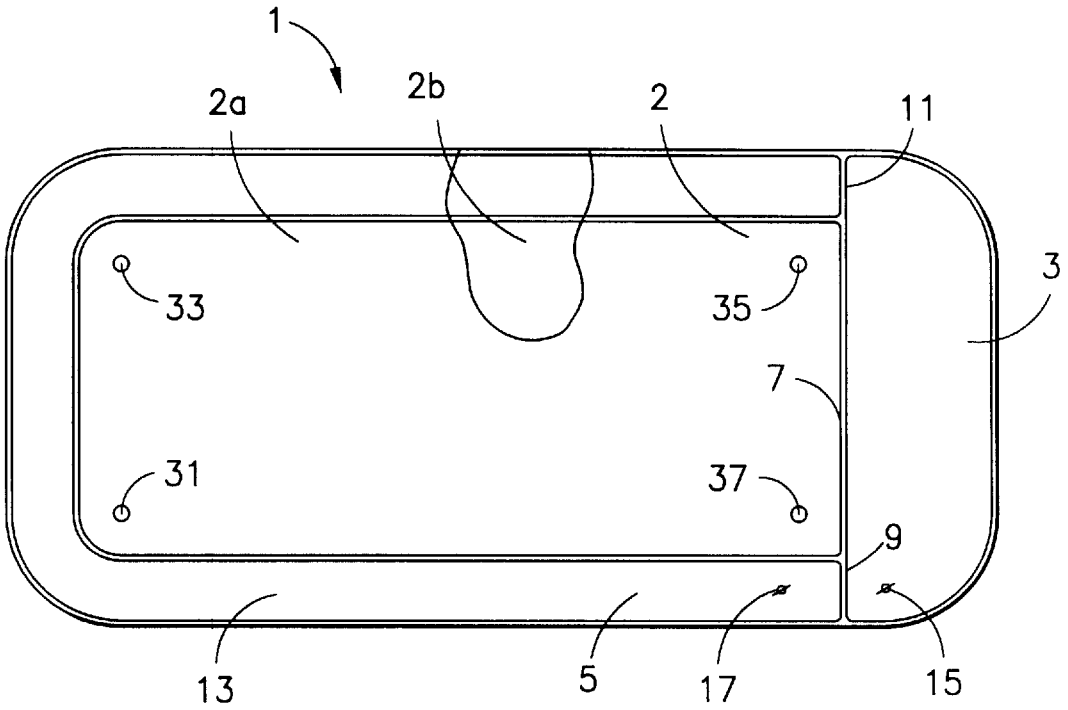
FIG. 1 is a top section view of an inflatable beach bed according to the invention in an uninflated state.

Referring to FIG. 1, an inflatable beach bed is provided having a largely rectangular appearance. The beach bed is formed of a single plane 1 of flexible material. Preferably, the plane 1 is made out of PVC-foil of a limited thickness, e.g. 0.20 mm. The plane 1 is shaped in such a way that it is made up of an inner double-walled central part 2, (wall 2*a*, 2*b*) a double-walled end part 3, and a further double-walled U-shaped side part 5.

Seals 7, 9, 11, 13 are made in this plane between parts 3 and 5, preferably by means of heat sealing. The end part 3 and the U-shaped part 5 are fitted with molded air valves 15, 17.

Figure 2:
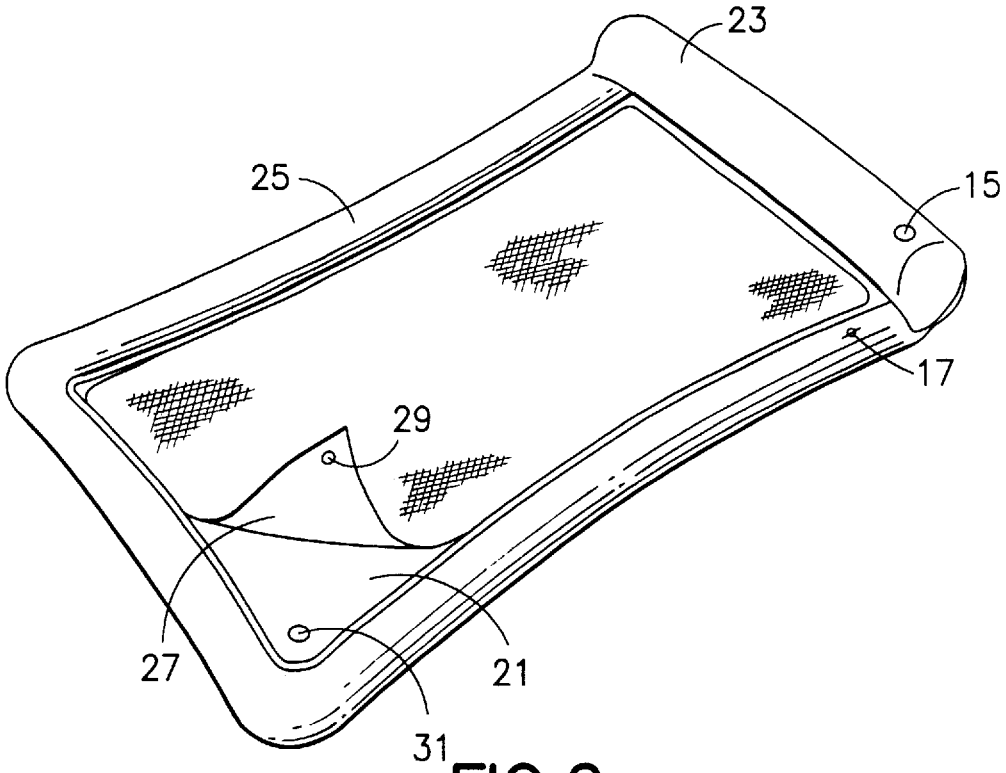
FIG. 2 is a perspective view showing an inflatable beach bed according to the invention in an inflated state.

Referring to FIG. 2, forcing air through the valves 15, 17 into parts 3 and 5 of the plane 1 inflates the end part 3 to form a pillow 23 and inflates the U-shaped part 5 to form a raised edging 25. An inflated beach bed according to the invention is thereby provided, in which an inner part 21 is surrounded by the raised edging 25; i.e., the inner part is boxed-in. The inner part 21 is thereby surrounded with upright, inflated edges, and takes on a taut appearance. Preferably, the sides of the inflated U-shaped part 5 become somewhat deformed, and thereby result in the sides being slightly convex.

It will be appreciated that the inflated beach bed is particularly suitable for use on sandy surface, such that when a person lies on the inner part 21, indirect contact with the underlying sandy surface is maintained. The inner part 21 easily adapts to the shape of the underlying surface and/or the user who is lying on top of it. In addition, the taut and planar inner part 21 may be printed with an advertisement.

Referring to FIGS. 1 and 2, a beach towel 27 having a fastener 29 may be coupled to the inner part 21 by a plurality of coupling agents 31, 33, 35, 37 provided on the inner part. For example, a button/button hole structure or Velcro may be used to couple the beach towel 27 to the inner part 21.

The item can be deflated after use and because the plane is thin-walled and flexible it can easily be folded to a light, thin package, requiring minimal storage space.

The invention has only been illustrated from the point of view of a single design model. Many variations are possible of course. Instead of the rectangular shape it is also possible to use other shapes, e.g. semi-circular, square shapes, etc. If desired various raised parts 23 can be fitted. It is also possible to fit the end part 3 and the U-shaped part 5 with other molded inflatable compartments, e.g. cross-ties, ornaments, cup holders, etc.

In the embodiment shown the end part 3 and the U-shaped part 5 are separately inflatable to form the pillow 23 and the raised edging 25. The advantage of this is that it becomes a great deal easier to inflate the item and that it becomes possible to if so desired inflate the pillow 23 to a different degree. Alternatively, the end part 3 and the U-shaped part 5 may be inflatable as one single inflatable chamber. One manner of creating a single inflatable chamber would be to partly interrupt the seals 9 and 11 in the plane 1. One added advantage of only partly interrupting seals 9 and 11, rather than completely removing seals 9 and 11, is that the pillow part 23 in its inflated state can still be moved somewhat independently from the rest of the beach bed.

As a result of the shape selected for the plane according to FIG. 1 with the beach item in inflated state the sealed joint between the head part 23 and the U-shaped edges 25 will be situated about halfway down the height of the inflated parts. As a result of this the item can, if so desired, also be used upside down. Also when used the other way around the beach bed still has the appearance shown in FIG. 2. On both surfaces of the inner part 21 it is for example possible to fit molded inflatable parts that are mutually different to both sides.

In the preferred embodiment the central plane part 2 (respectively 21) is double-walled. In the manufacture of the plane 1, one a flexible material having double the dimensions of the inflatable beach bed shown in FIG. 1 can be used. By making sealed joints 7 and 13, a very strong, stable, and double-sided inner part 21, results. Alternatively, a single-walled inner part 2 may be used having smaller dimensions, which is attached by heat seals to the double-walled inflatable edges 3 and 5.

By way of example only, the diameter of the head 23 is 31 cm. and the diameter of the inflated part 5 is 18 cm.; the external dimensions of the plane are 208×116 cm. and those of the central part 160×81 cm. The flexible thin synthetic material used which is made of PVC-foil, preferably has a thickness of 0.20 mm.

The beach bed shown is intended for one person. It will be appreciated that the dimensions could also be such that the bed becomes suitable for use by several people. It would then be preferable to provide this beach bed with at least two higher, separately inflatable parts 23 that can act as head rests.

By way of example only, the dimensions for the plane for a multiple person beach bed are 208×166 cm., with a central part 2 of 160×131 cm., and a PVC-foil thickness of 0.25 mm.

It will be appreciated that the beach bed according to the invention has a number of advantages. First, the beach bed offers a comfortable lying surface which minimizes the potential for sand to blow over the lying surface. Second, a beach towel can be fastened thereon such that the beach towel does not blow away. Third, the inflatable part provides the user with comfortable head, arm and leg rests. Fourth, the inner part adapts to the shape of the user's body and to the sandy surface. Firth, only a limited amount of air is needed to inflate it compared to air mattresses. Sixth, the beach bed may be printed upon for advertising purposes. Seventh, the beach bed is very stable. Eighth, all of the items the user has brought along with him stay free of sand when placed in the beach bed.

It will therefore be appreciated by those skilled in the art that yet other modifications could be made to the provided invention without deviating from its spirit and scope as so claimed.

We claim:

1. An inflatable beach bed, comprising:

a double-walled, flexible plane having an uninflatable central part and at least one inflatable part located around the periphery of the central part and separated from said central part by at least one heat seal, said inflatable part including a raised contour part relative to the rest of the inflatable part, wherein said central part and said at least one inflatable part form a boxed-in area, and when said at least one inflatable part is inflated, said at least one inflatable part has an effective height and said central part is situated approximately halfway down the effective height.

2. An inflatable beach bed according to claim 1, wherein:

said raised contour part is inflatable separately from said at least one inflatable part.

3. An inflatable beach bed according to claim 1, wherein:

said at least one inflatable part is situated around the periphery of said central part such that said central part is held taut by inflation of said inflatable part.

4. An inflatable beach bed according to claim 1, wherein:

said central part is fitted with means for attaching a beach towel to said inflatable beach bed.

5. An inflatable beach bed according to claim 1, wherein:

said flexible plane is made out of synthetic material.

6. An inflatable beach bed according to claim 5, wherein:

said synthetic material is PVC.

* * * * *